US008748357B2

(12) United States Patent
Habeeb et al.

(10) Patent No.: US 8,748,357 B2
(45) Date of Patent: Jun. 10, 2014

(54) METHOD FOR STABILIZING DIESEL ENGINE LUBRICATING OIL AGAINST DEGRADATION BY BIODIESEL FUEL

(75) Inventors: Jacob J. Habeeb, Westfield, NJ (US); Ramesh Varadaraj, Flemington, NJ (US); Brandon T. Weldon, Pearland, TX (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 482 days.

(21) Appl. No.: 12/459,978

(22) Filed: Jul. 10, 2009

(65) Prior Publication Data

US 2010/0016193 A1 Jan. 21, 2010

Related U.S. Application Data

(60) Provisional application No. 61/134,918, filed on Jul. 15, 2008.

(51) Int. Cl.
*C10M 105/32* (2006.01)

(52) U.S. Cl.
USPC ..... 508/110; 508/371; 508/563; 508/584

(58) Field of Classification Search
CPC ..... C10M 2215/064; C10M 2207/026; C10M 2219/068
USPC ..... 508/110, 371, 563, 584
See application file for complete search history.

(56) References Cited

U.S. PATENT DOCUMENTS

| | | | | |
|---|---|---|---|---|
| 4,827,064 | A | 5/1989 | Wu | |
| 4,827,073 | A | 5/1989 | Wu | |
| 4,889,647 | A | 12/1989 | Rowan et al. | |
| 4,956,122 | A | 9/1990 | Watts et al. | |
| 4,978,464 | A | 12/1990 | Coyle et al. | |
| 5,436,379 | A * | 7/1995 | Heilman et al. | 585/10 |
| 5,824,627 | A | 10/1998 | McConnachie et al. | |
| 5,925,600 | A | 7/1999 | Atherton | |
| 6,300,292 | B2 | 10/2001 | Konishi et al. | |
| 2006/0223724 | A1 | 10/2006 | Gatto et al. | |
| 2006/0258549 | A1 | 11/2006 | Habeeb et al. | |
| 2007/0203035 | A1 * | 8/2007 | Dong et al. | 508/485 |

FOREIGN PATENT DOCUMENTS

| | | | |
|---|---|---|---|
| EP | 0 725 130 | B1 | 8/1996 |
| EP | 0 896 050 | A1 | 2/1999 |
| EP | 1 006 173 | A1 | 6/2000 |
| EP | 1 040 115 | B1 | 10/2000 |
| EP | 1 878 784 | A1 | 1/2008 |
| EP | 2055762 | A | 5/2009 |
| JP | 59 041388 | | 8/1982 |
| JP | 09 272887 | | 10/1997 |
| WO | 9810041 | | 3/1998 |
| WO | PCT/WO 99/31113 | | 6/1999 |
| WO | WO 2007/115042 | A | 10/2007 |

OTHER PUBLICATIONS

Parsons, Gary M., "Biodiesel and Engine Lubrication, Part 2", Lubrication Magazine (online), Dec. 2007, retrieved on Nov. 27, 2009 from the Internet: URL:http://www.ehwolf.com/Oct_07_Lubrication_Mag_P2_(biodiesel).pdf>.

Shold, David M., "Engine Lubricant Using Molybdenum Dithiocarbamate as an Antioxidant Top Treatment in High Sulfur Base Stocks", IP.Com Journal, IP.Com, Inc., May 14, 2001.

Rudnick, Leslie R., "Chapter 1: Antioxidants", Lubricant Additives: Chemistry and Applications (Cyril A. Migdal, editor), Jan. 1, 2003, pp. 1-27.

Milton Johnson, et al., "Additive Interactions and Depletion Processes in Fuel Efficient Engine Oils", SP-1271—1997 SAE International Spring Fuels and Lubricants Meeting, Dearborn, Michigan, May 5-8, 1997, pp. 33-38.

Satoru Yoshida, et al., "The Effect of Ashless Antioxidants Type on Friction Reduction Durability on Engine Oils Containing MoDTC", SAE International—Powertrain and Fluid Systems Conference and Exhibition, Toronto, Canada, Oct. 16-19, 2006.

* cited by examiner

*Primary Examiner* — Taiwo Oladapo
(74) *Attorney, Agent, or Firm* — Robert A. Migliorini

(57) ABSTRACT

The lubricating oil used to lubricate diesel engines is stabilized against the detrimental degradation effects of biodiesel fuel by the addition to the lubricating oil of an additive concentrate comprising a premix of a first antioxidant, a second antioxidant of a type different from the first and an organometallic compound.

4 Claims, No Drawings

METHOD FOR STABILIZING DIESEL ENGINE LUBRICATING OIL AGAINST DEGRADATION BY BIODIESEL FUEL

Non-Provisional Application based on Provisional Application No. 61/134,918 filed Jul. 15, 2008.

BACKGROUND OF THE INVENTION

1. Field of the Invention

The present invention relates to the lubrication of diesel engines run on biodiesel fuels and to the stabilization of the lubricating oil against degradation induced by the biodiesel fuels.

2. Description of the Related Art

In an effort to reduce the dependency on petroleum-based hydrocarbon fuels, various renewable sources of fuels have been identified and investigated.

Diesel fuels, traditionally petroleum hydrocarbon fractions or synthetic hydrocarbon fractions such as hydrocarbons derived from Fischer-Tropsch processes and boiling in the distillate boiling range of are viewed as non-renewable resource fuels, being produced either from crude oil or, by various synthetic reactions, from natural gas.

Lubricating oils containing one or more phenolic antioxidants and/or one or more aromatic amine antioxidants and/or zinc dialkyl diphenylamine are known in the literature.

EP 1,878,784 teaches a long life fuel saving engine oil composition comprising a mineral and/or synthetic base oil, an amine antioxidant and a phenolic antioxidant, and molybdenum dithiocarbamate. The oil is described as exhibiting excellent oxidative stability at high temperatures. In addition to the components recited above, the lubricating oil composition may also contain other additives such as detergent, zinc dialkyl dithiophosphate, ashless dispersants, VI improvers, pour point depressants, metal deactivators, rust preventors and anti-foaming agents. In the Examples, formulations containing phenolic antioxidants, amine antioxidants, MoDTC and further containing ZDDP are presented. The formulation exhibited excellent oxidation stability in the Sequence IIIG test.

U.S. 2006/0223724 teaches a lubricating oil of reduced phosphorus levels which retains excellent viscosity control; i.e., excellent oxidation stability. The oil comprises a major amount of one or more of a Group II, Group III, Group IV and synthetic ester base stock, 4,4' methylenebis (2,6 ditertbutyl phenol), an alkylated diphenyl amine, a detergent and zinc dialkyldithiophosphate. Optionally an oil soluble organomolybdenum compound can be present, as can additional, different hindered phenolic antioxidants. The lubricant contains about 600 ppm or less phosphorus derived from the ZDDP. In the Examples, a preblend was prepared consisting of a 150N Group II base oil, an ashless dispersant, an overbased detergent, a neutral detergent and a secondary zinc dialkyldithiophosphate. To the preblend various other components were added individually, including various hindered phenols and aromatic amines. A number of examples contain all three of ZDDP, a hindered phenol and an aromatic amine.

U.S. Pat. No. 6,300,292 teaches an hydraulic oil of excellent oxidative stability comprising a vegetable oil base oil and at least one antioxidant selected from the group consisting of a phenol antioxidant, an amine antioxidant and a zinc dithiophosphate antioxidant in an amount of 0.01 to 5 wt % based on the total composition. The vegetable oil can be rapeseed oil, sunflower oil, soybean oil, corn oil, canola oil, mixed oil. The vegetable oil has a total degree of unsaturation of 0.3 or less and an oleic acid content of not less than 70% by mass in triglyceride-constituting fatty acids.

The antioxidants can be used individually or as a combination of two or three of such components. In a mixture of three components the ratio by weight may be 1:1:1. There are no examples of any formulation containing all three suggested antioxidant types, let alone as a premix.

EP 1,006,173 teaches a lubricant exhibiting extended oxidation stability comprising a hydraulic oil anti-wear component and a base oil and an additive comprising an amine antioxidant and at least one additional antioxidant selected from ashless dithiocarbamate, sulfurized olefin and phenolic antioxidant. The base oil can include animal oils and vegetable oils. The hydraulic oil anti-wear additive is hydraulic grade zinc dialkyldithiophosphate. Formulations containing ZDDP, a phenolic antioxidant and one or more aminic antioxidants are reported. It does not appear that a premix was employed.

EP 0,896,050 teaches a lubricating oil comprising a particular base oil and an oxidation inhibitor. The base oil is a mineral oil-derived lubricant having a saturated hydrocarbon content of 80% or more by mass and a viscosity-density constant of the saturated hydrocarbon component of 0.79 or less. The antioxidant is selected from the group consisting of hindered phenolic, aromatic aminic and sulfur containing antioxidants. Sulfur containing antioxidants include zinc dihydrocarbyl dithiophosphate. The antioxidant can be a single material or a mixture of two or more components in any ratio. There were no examples containing antioxidants from all three categories in a single formulation.

EP 0,725,130 teaches a lubricating oil highly resistant to oxidation by nitrogen oxides. The lubricant consists of a hydrocarbon oil base oil, molybdenum dithiocarbamate, zinc dithiophosphate and a phenol antioxidant. Additional additives can be present, including amine-based antioxidants. There were no examples of a lubricant containing an amine antioxidant in addition to the zinc dithiophosphate and phenol antioxidant.

"Additive Interactions and Depletion Processes in Fuel Effluent Engine Oils", Johnson, Millen, et al., SAE Technical Paper Seven 971694, May 5-8, 1997. This paper investigates the interaction between molybdenum dithiocarbamate and zinc dialkyldithiophosphate and phenolic antioxidants. The presence of the antioxidants inhibits oxidation caused by peroxy radicals by trapping the radicals and reducing the rate of oxidation. The use of additional presence of aminic antioxidants is not mentioned or discussed.

JP 09 272882 teaches a hydraulic oil comprising a mineral oil having an aromatic content of 1.5 mass % or less and dialkyl zinc dithiophosphate, 2,6 di-tert-butyl-4 methyl phenol and P-P' dioctyl diphenyl amine.

JP 59 041388 teaches the stabilization of coal liquefaction oil by the addition of a radical stabilizer containing hindered phenol, aromatic sec- or tert-amine and metallic dithiophosphate. The stabilizer is added to the oil prior to heating and prevents coking.

Biodiesel fuels have been identified as an alternative to conventional distillate fuels.

Biodiesel fuels are based on the trans-esterification of triglyceride of fatty acids secured from vegetable oils and animal fats. Trans-esterification of the vegetable oils and animal fats into fatty acid alkyl esters is necessary to reduce the viscosity of the vegetable oils and/or animal fats to more closely resemble that of traditional diesel fuel.

Vegetable-based biodiesel is currently the more common of the biodiesel fuels. Vegetable oils used as base stock sources include soy, rapeseed, palm, cottonseed, peanut, sunflower, coconut, canola, etc. while animal fats include lard, tallow, fish oil, poultry fat, etc.

Trans-esterification employs alcohols in the presence of a catalyst. The alcohol can be any $C_1$ to $C_5$ alkyl alcohol, but, for the sake of economy, methanol is the most widely used alcohol. The biodiesel is commonly identified by reference to its plant source. Thus there exist soy alkyl ester, rapeseed alkyl ester, cottonseed alkyl ester, etc. fuels, typically soy methyl ester (SME) and rapeseed methyl ester (REM).

It is readily apparent, therefore, that such alkyl ester fuels are mixtures of molecules of various molecular weight with ester functionality and often with one or two double bonds in the alkyl group associated with the fatty acid starting materials.

Such ester functionalities and olefinic double bonds are chemically active groups making biodiesel fuel chemically and kinetically unstable, causing both the biodiesel fuel itself and the hydrocarbon-based lubricating oil to oxidize, prematurely resulting in sludge and deposit formation in the engine.

Despite this susceptibility to early oxidation, biodiesel is an attractive fuel source because in comparison to conventional diesel fuel, biodiesel fuels are derived from renewable sources and exhibit improved performance in $CO_2$, CO, hydrocarbon and particulate matter emissions while having at least equivalent or in some instances superior cetane numbers.

Thus it would be an advance if a way could be found to reduce or eliminate the harmful early oxidation of the diesel lubricant associated with the use of biodiesel fuel.

DESCRIPTION OF THE INVENTION

A method is disclosed for controlling; i.e., reducing or eliminating, the oxidation of diesel engine lubricating oils caused by the use of biodiesel fuels, said method comprising the addition to the lubricating oil of an additive comprising a premixed mixture of (A) a first antioxidant selected from one or more of a phenolic antioxidant, one or more of an aromatic aminic compound antioxidant, one or more of an oil-soluble copper compound antioxidant, one or more of a catalytic antioxidant selected from the group consisting of one or more oil-soluble organometallic compounds and/or organometallic coordination complexes selected from the group consisting of:

(a) one or more metal(s) or metal cation(s) having more than one oxidation state above the ground state, excluding iron and nickel, complexed, bonded, or associated with two or more anions;

(b) one or more metal(s) or metal cation(s) having more than one oxidation state above the ground state, excluding iron and nickel, complexed, bonded, or associated with one or more bidentate or tridentate ligands;

(c) one or more metal(s) or metal cation(s) having more than one oxidation state above the ground state, excluding iron and nickel, complexed, bonded or associated with one or more anions and one or more ligands;

provided the anion and/or ligand does not itself render the metal cation inactive; i.e., renders the metal cation unable to change from one oxidation state above the ground state to another oxidation state above the ground state, decompose or cause polymerization of the metal salt thereby rendering the metal cation inactive as a peroxide decomposer, and further provided that (a) when the metal or metal cation is molybdenum, the ligand is not thiocarbamate, thiophosphate, dithiocarbamate or dithiophosphate and (b) when the metal or metal cation is copper the ligand is not acetyl acetate, (B) a second antioxidant which is selected from one or more of a phenolic antioxidant, one or more of an aromatic aminic compound antioxidant, one or more of an oil-soluble copper compound antioxidant, one or more of a catalytic antioxidant selected from the group consisting of one or more oil-soluble organometallic compounds and/or organometallic coordination complexes selected from the group consisting of:

(a) one or more metal(s) or metal cation(s) having more than one oxidation state above the ground state, excluding iron and nickel, complexed, bonded, or associated with two or more anions;

(b) one or more metal(s) or metal cation(s) having more than one oxidation state above the ground state, excluding iron and nickel, complexed, bonded, or associated with one or more bidentate or tridentate ligands;

(c) one or more metal(s) or metal cation(s) having more than one oxidation state above the ground state, excluding iron and nickel, complexed, bonded or associated with one or more anions and one or more ligands;

provided the anion and/or ligand does not itself render the metal cation inactive; i.e., renders the metal cation unable to change from one oxidation state above the ground state to another oxidation state above the ground state, decompose or cause polymerization of the metal salt thereby rendering the metal cation inactive as a peroxide decomposer, and further provided that (a) when the metal or metal cation is molybdenum, the ligand is not thiocarbamate, thiophosphate, dithiocarbamate or dithiophosphate and (b) when the metal or metal cation is copper the ligand is not acetyl acetate, wherein said first and second antioxidants are not the same and are of different types from within the recited group of antioxidants, and (C) one or more of an organometallic compound selected from YDDP, molybdenum DTC, molybdenum DTP or organomolybdenum-nitrogen complexes wherein Y is zinc or copper.

The additive comprises a mixture of (A) at least one first antioxidant selected from one or more of a phenol, one or more of an aromatic aminic compound antioxidant, one or more of a soluble copper compound antioxidant, one or more of an organometallic coordination complex selected from the group consisting of (a) one or more metal(s) or metal cation(s) having more than one oxidation state above the ground state, excluding iron and nickel, complexed, bonded, or associated with two or more anions;

(b) one or more metal(s) or metal cation(s) having more than one oxidation state above the ground state, excluding iron and nickel, complexed, bonded, or associated with one or more bidentate or tridentate ligands;

(c) one or more metal(s) or metal cation(s) having more than one oxidation state above the ground state, excluding iron and nickel, complexed, bonded or associated with one or more anions and one or more ligands;

provided the anion and/or ligand does not itself render the metal cation inactive; i.e., renders the metal cation unable to change from one oxidation state above the ground state to another oxidation state above the ground state, decompose or cause polymerization of the metal salt thereby rendering the metal cation inactive as a peroxide decomposer, and further provided that (a) when the metal or metal cation is molybdenum, the ligand is not thiocarbamate, thiophosphate, dithiocarbamate or dithiophosphate and (b) when the metal or metal cation is copper the ligand is not acetyl acetate, (B) at least one second antioxidant which is selected from one or more of a phenol, one or more of an aromatic aminic compound antioxidant, one or more of a soluble copper compound antioxidant, one or more of an organometallic coordination complex selected from the group consisting of (a) one or more metal(s) or metal cation(s) having more than one oxidation state above the ground state, excluding iron and nickel, complexed, bonded, or associated with two or more anions;

(b) one or more metal(s) or metal cation(s) having more than one oxidation state above the ground state, excluding iron and nickel, complexed, bonded, or associated with one or more bidentate or tridentate ligands;

(c) one or more metal(s) or metal cation(s) having more than one oxidation state above the ground state, excluding iron and nickel, complexed, bonded or associated with one or more anions and one or more ligands;

provided the anion and/or ligand does not itself render the metal cation inactive; i.e., renders the metal cation unable to change from one oxidation state above the ground state to another oxidation state above the ground state, decompose or cause polymerization of the metal salt thereby rendering the metal cation inactive as a peroxide decomposer, and further provided that (a) when the metal or metal cation is molybdenum, the ligand is not thiocarbamate, thiophosphate, dithiocarbamate or dithiophosphate and (b) when the metal or metal cation is copper the ligand is not acetyl acetate, provided said first and second antioxidants are not the same and are different types from within the recited group and (C) at least one organometallic component selected from the group consisting of YDDP, molybdenum DTC, molybdenum DTP, and organo-molybdenum nitrogen complexes, wherein Y is zinc or copper, said components (A):(B):(C) being employed in a ratio of 1-10:1-10:1-10, preferably about 1-5:1-5:1-5, more preferably about 1-2:1-2:1-2, said component being premixed before addition to the diesel lubricating oil.

The phenols include sulfurized and non-sulfurized phenolic antioxidants. The terms "phenolic type" or "phenolic antioxidant" used herein includes compounds having one or more than one hydroxyl group bound to an aromatic ring which may itself be mononuclear; e.g., benzyl, or polynuclear; e.g., naphthyl and spiro aromatic compounds. Thus "phenol type" includes phenol per se, catechol, resorcinol, hydroquinone, naphthol, etc., as well as alkyl or alkenyl and sulfurized alkyl or alkenyl derivatives thereof, and bisphenol type compounds including such bi-phenol compounds linked by alkylene bridges, sulfur bridges or oxygen bridges. Alkyl phenols include mono- and poly-alkyl or alkenyl phenols, the alkyl or alkenyl group containing from about 3-100 carbons, preferably 4-50 carbons and sulfurized derivatives thereof, the number of alkyl or alkenyl groups present on the aromatic ring ranging from 1 to up to the available unsatisfied valences of the aromatic ring remaining after counting the number of hydroxyl groups bound to the aromatic ring.

Generally, therefore, the phenolic antioxidant may be represented by the general formula:

$$(R^A)_x—Ar—(OH)y$$

where Ar is selected from the group consisting of:

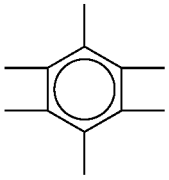

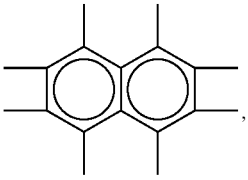

-continued

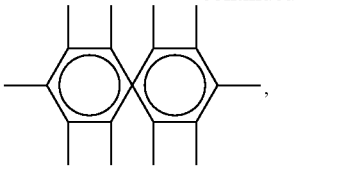

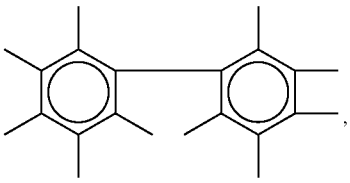

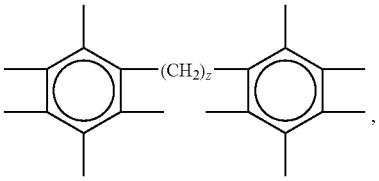

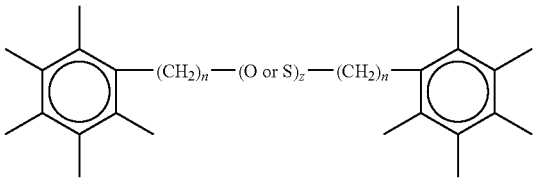

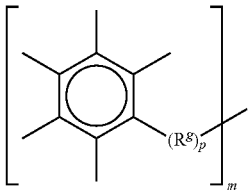

wherein $R^A$ is hydrogen or a $C_3$-$C_{100}$ alkyl or alkenyl group, a sulfur substituted alkyl or alkenyl group, preferably a $C_4$-$C_{50}$ alkyl or alkenyl group or sulfur substituted alkyl or alkenyl group, more preferably $C_3$-$C_{100}$ alkyl or sulfur substituted alkyl group, most preferably a $C_4$-$C_{50}$ alkyl group, $R^g$ is a $C_1$-$C_{100}$ alkylene or sulfur substituted alkylene group, preferably a $C_2$-$C_{50}$ alkylene or sulfur substituted alkylene group, more preferably a $C_2$-$C_{20}$ alkylene or sulfur substituted alkylene group, y is at least 1 to up to the available valences of Ar, x ranges from 0 to up to the available valences of Ar-y, z ranges from 1 to 10, n ranges from 0 to 20, and m is 1 to 5 and p is 1 or 2, preferably y ranges from 1 to 3, x ranges from 0 to 3, z ranges from 1 to 4 and n ranges from 0 to 5, and p is 1.

Preferred phenolic antioxidant compounds are hindered phenolics which contain a sterically hindered hydroxyl group, and these include those derivatives of dihydroxy aryl compounds in which the hydroxyl groups are in the o- or p-position to each other. Typical phenolic antioxidants include the hindered phenols substituted with $C_1$+ alkyl groups and the alkylene sulfur bridge or oxygen bridge coupled derivatives of these hindered phenols. Examples of phenolic materials of this type include 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol; 2-methyl-6-t-butyl-4-dodecyl phenol; 2,6-di-t-butyl-4-methyl phenol; 2,6-di-t-butyl-4-ethyl phenol; and 2,6-di-t-butyl 4 alkoxy phenol. Other useful hindered mono-phenolic antioxidants may include for example hindered 2,6-di-alkyl-phenolic proprionic ester derivatives. Bis-phenolic antioxidants may also be advantageously used in combination with the instant invention. Examples of ortho coupled bis-phenols include: 2,2'bis (6-t-butyl-4-heptyl phenol); 2-2'-bis(6-t-butyl-4-octyl phenol); and 2,2'-bis(6-t-butyl-4-dodecyl phenol). Para coupled bis-phenols include, for example, 4,4'-bis(2,6-di-t-butyl phenol) and 4,4'-methylene-bis(2,6-di-t-butyl phenol).

Phenolic type antioxidants are well known in the lubricating industry and commercial examples such as Ethanox® 4710, Irganox® 1076, Irganox® L1035, Irganox® 1010, Irganox® L109, Irganox® L118, Irganox® L135 and the like are familiar to those skilled in the art. The above is presented only by way of exemplification, not limitation on the type of phenolic antioxidants which can be used in the present invention.

Examples of suitable copper antioxidants include copper dihydrocarbyl thio- or dithio-phosphates, copper polyisobutylene succinic anhydride and copper salts of carboxylic acid (naturally occurring or synthetic). Other suitable copper salts include copper dithiocarbamates, sulphonates, phenates, and acetylacetonates. Basic, neutral, or acidic copper Cu(I) and/or Cu(II) salts derived from alkenyl succinic acids and anhydrides are known to be particularly useful.

Oil soluble organometallic compounds and/or oil soluble organometallic coordination complexes suitable for use as a first antioxidant in the present invention are materials selected from the group consisting of:

(a) one or more metal(s) or metal cation(s) having more than one oxidation state above the ground state, excluding iron and nickel, complexed, bonded, or associated with two or more anions;

(b) one or more metal(s) or metal cation(s) having more than one oxidation state above the ground state, excluding iron and nickel, complexed, bonded, or associated with one or more bidentate or tridentate ligands;

(c) one or more metal(s) or metal cation(s) having more than one oxidation state above the ground state, excluding iron and nickel, complexed, bonded or associated with one or more anions and one or more ligands; or (d) mixtures thereof.

provided the anion and/or ligand does not itself render the metal cation inactive; i.e., renders the metal cation unable to change from one oxidation state above the ground state to another oxidation state above the ground state, decompose or cause polymerization of the metal salt thereby rendering the metal cation inactive as a peroxide decomposer, and further provided that (a) when the metal or metal cation is molybdenum, the ligand is not thiocarbamate, thiophosphate, dithiocarbamate or dithiophosphate and (b) when the metal or metal cation is copper the ligand is not acetyl acetate.

Materials of this type are disclosed and claimed in published application U.S. 2006/0258549, published Nov. 16, 2006, incorporated herein in its entirety by reference.

Aromatic aminic compound antioxidants include alkylated or non-alkylated aromatic amines such as aromatic monoamine of the formula:

$$R^1R^2R^3N$$

where $R^1$ is an aliphatic, aromatic or substituted aromatic group, $R^2$ is an aromatic or a substituted aromatic group and $R^3$ is hydrogen, alkyl, aryl or $R^4S(O)nR^5$, wherein $R^4$ is alkylene, alkenylene or arylalkylene group and $R^5$ is a higher alkyl group, or an alkenyl, aryl or alkaryl group and n is 0, 1 or 2. When $R^1$ is an aliphatic group it may contain from 1 to about 20 carbon atoms, and preferably contains from about 6 to 12 carbon atoms. The aliphatic group is a saturated aliphatic group. Preferably both $R^1$ and $R^2$ are aromatic or substituted aromatic group and the aromatic group may be a single ring or fused multi-ring aromatic group such as naphthyl aromatic group. $R^1$ and $R^2$ may be joined together with other groups such as sulfur. $R^3$ is preferably hydrogen.

Typical aromatic amine antioxidants are diphenyl amine and phenyl naphthylamine, wherein the phenol and/or naphthyl group(s) has (have) alkyl substituted group(s) of at least about 6 carbon atoms.

Examples of aliphatic groups include hexyl, heptyl, octyl, nonyl, and decyl. Generally the aliphatic groups will not contain more than about 14 carbon atoms. The general types of amine antioxidants useful in the present compositions include diphenylamines, phenyl naphthylamines, phenothiazines, imidodibenzyls and diphenyl phenylene diamines. Mixtures of two or more aromatic amines are also useful. Polymeric amine antioxidants can also be used. Particular examples of aromatic amine antioxidants useful in the present invention include: p,p'-dioctyldiphenylamine; t-octylphenyl-alpha-naphthylamine; phenyl-alphanaphthylamine; and p-octylphenyl-alpha-naphthylamine.

As is clear, two different antioxidants are employed in the premix. By two different antioxidants is meant for the purposes of the present specification and the appended claims that they are different in terms of type. Thus the use of two different phenolic antioxidants would not satisfy the requirement that two different antioxidants be employed. The use of, e.g., one or more phenolic antioxidants and one or more aromatic aminic antioxidants, however, would satisfy the recited requirement that the first and second antioxidant are not the same and are of different types from within the recited group of antioxidants.

The third essential component of the additive premix is an organometallic compound selected from the group consisting of Y dialkyl dithophosphate (YDDP), molybdenum dithiocarbamate (Moly DTC), molybdenum dithiophosphate (Moly DTP), organo molybdenum nitrogen compounds and mixtures thereof, wherein Y is zinc and/or copper.

YDDP compounds are generally of the formula:

$$Y[SP(S)(OR^4)(OR^5)]_2$$

where R1 and $R^2$ are $C_1$-$C_{18}$ alkyl groups, preferably $C_2$-$C_{12}$ alkyl groups. These alkyl groups may be straight chain or branched; i.e., the alkyl groups can be either primary alkyl or secondary alkyl groups. Y is zinc or copper.

Molybdenum dithiocarbamates (Moly DTC) are materials generally of the formula:

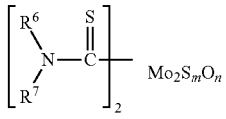

wherein $R^6$ and $R^7$ are independently a hydrocarbon group with 8 to 18 carbon atoms and may or may not be the same, m and n are a positive integer provided that m+n=4.

Examples of the hydrocarbon group having 8 to 18 carbon atoms, represented by $R^6$ and $R^7$ in the general formula include hydrocarbon groups such as an alkyl group having 8 to 18 carbon atoms, an alkenyl group having 8 to 18 carbon atoms, a cycloalkyl group having 8 to 18 carbon atoms, an aryl group having 8 to 18 carbon atoms, an alkylaryl group and an arylalkyl group. The above alkyl and alkenyl groups may be linear or branched. In the lubricating oil composition of the present invention, it is particularly preferable that the hydrocarbon group represented by $R^6$ and $R^7$ have 8 carbon atoms.

Specific examples of the hydrocarbon group represented by $R^6$ and $R^7$ include octyl, nonyl, decyl, undecyl, dodecyl, tridecyl, octenyl, noneyl, decenyl, undecenyl, dodecenyl, tridecenyl, tetradecenyl, hexadecenyl, octadecenyl, dimethylcyclohexyl, ethylcyclohexyl, methylcyclohexylmethyl, cyclohexylethyl, propylcyclohexyl, butylcyclohexyl, heptylcyclohexyl, dimethylphenyl, methylbenzyl, phenethyl, naphthyl and dimethylnaphthyl groups.

Molybdenum dithiophosphates (Moly DTP) are materials generally of the formula:

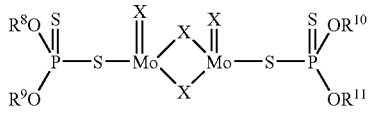

wherein $R^8$, $R^9$, $R^{10}$ and $R^{11}$ are the same or different hydrocarbyl groups containing 8 to 18 carbon atoms, X is oxygen or sulfur, preferably $R^8$ to $R^{11}$ are $C_8$ to $C_{18}$ alkyl, alkenyl, cycloalkyl, aryl, alkylaryl, aralkyl, more preferably alkyl, most preferably $C_8$ to $C_{10}$ alkyl.

The term "organo molybdenum-nitrogen complexes" as used in the text and appended claims to define certain molybdenum complexes useful in the present invention embrace the organo molybdenum-nitrogen complexes described in U.S. Pat. No. 4,889,647. The complexes are reaction products of a fatty oil, diethanolamine and a molybdenum source. Specific chemical structures have not been assigned to the complexes. U.S. Pat. No. 4,889,647 reports an infrared spectrum for a typical reaction product of that invention; the spectrum identifies an ester carbonyl band at 1740 $cm^{-1}$ and an amide carbonyl band at 1620 $cm^{-1}$. The fatty oils are glyceryl esters of higher fatty acids containing at least 12 carbon atoms up to 22 carbon atoms or more. The molybdenum source is an oxygen-containing compound such as ammonium molybdates, molybdenum oxides and mixtures.

Other organo molybdenum complexes which can be used in the present invention are tri-nuclear molybdenum-sulfur compounds described in EP 1 040 115 and WO 99/31113 and the molybdenum complexes described in U.S. Pat. No. 4,978,464.

The additive is employed as a premix. The components are employed in an (A):(B):(C) ratio in the range of 1-10:1-10:1-10, preferably 1-5:1-5:1-5, more preferably 1:1:1, all ratios being based on active ingredient.

The premix is added to the lubricating oil in an amount in the range of about 0.01 to 20 wt %, based on active ingredient of the components in the premix, preferably about 0.01 to 15 wt %, more preferably about 0.01 to 10 wt %.

The premix is prepared by combining the first antioxidant, the second antioxidant (aromatic amine) and the organometallic compound in the desired ratio in the absence of any solvent or diluent and mixing at 59-90° C. for 60 minutes with stirring to ensure complete interaction. While the order of addition of the components into the premix is left to the practitioner, it is preferred that the organometallic compound be added first, followed by the two antioxidants individually in sequence in any order and optionally any other additional additive, if desired.

The above-described premix can be added either to an already fully formulated diesel engine lubricating oil; that is, an engine oil which already contains its intended full complement of additives, including one or more antioxidants and one or more organometallic compounds which may already correspond to one or more of compounds (a), (b) and (c) in the premix, it can be added to a lubricating oil base stock as part of the additive package added to such base stock to make a formulated lubricating oil composition. In such an instance, the additives which can be added to the lubricating oil base stock can include one or more additional antioxidants of the type embraced by components (A) and (B), one or more additional organometallic compounds of the type embraced by component (C), viscosity index improvers, detergents, dispersants, metal deactivators, and wear additive, pour point depressants, corrosion inhibitors, seal compatibility additive anti-foam agents, inhibitors and anti-rust additives, friction modifiers, etc., all materials already well known to the practitioner, and documented in "Lubricants and Related Products" by Klamann, Verlag Chemie, Deerfield Beach, Fla., ISBN 0-89573-177-0, "Lubricant Additives" by M. W. Ranney, Noges Data Corporation, Parkridge, N.J. (1978) and "Lubricant Additives", C. V. Smallheer and R. K. Smith, Legiers-Helen Company, Cleveland, Ohio (1967).

A wide range of lubricating base oils is known in the art. Lubricating base oils are both natural oils and synthetic oils. Natural and synthetic oils (or mixtures thereof) can be used unrefined, refined, or rerefined (the latter is also known as reclaimed or reprocessed oil). Unrefined oils are those obtained directly from a natural or synthetic source and used without added purification. These include shale oil obtained directly from retorting operations, petroleum oil obtained directly from primary distillation, and ester oil obtained directly from an esterification process. Refined oils are similar to the oils discussed for unrefined oils except refined oils are subjected to one or more purification steps to improve at least one lubricating oil property. One skilled in the art is familiar with many purification processes. These processes include solvent extraction, secondary distillation, acid extraction, base extraction, filtration, and percolation.

Rerefined oils are obtained by processes analogous to refined oils but using an oil that has been previously used.

Groups I, II, III, IV and V are broad categories of base oil stocks developed and defined by the American Petroleum Institute (API Publication 1509; www.API.org) to create guidelines for lubricant base oils. Group I base stocks generally have a viscosity index of between about 80 to 120 and contain greater than about 0.03% sulfur and/or less than about 90% saturates. Group II 25 base stocks generally have a viscosity index of between about 80 to 120, and contain less than or equal to about 0.03% sulfur and greater than or equal to about 90% saturates. Group III stocks generally have a viscosity index greater than about 120 and contain less than or equal to about 0.03% sulfur and greater than about 90% saturates. Group IV includes polyalphaolefins (PAO). Group V base stock includes base stocks not included in Groups I-IV. The table below summarizes properties of each of these five groups.

| | Base Oil Properties | | |
|---|---|---|---|
| | Saturates | Sulfur | Viscosity Index |
| Group I | <90 and/or | >0.03% and | ≥80 and <120 |
| Group II | ≥90 and | ≤0.03% and | ≥80 and <120 |
| Group III | ≥90 and | ≤0.03% and | ≥120 |
| Group IV | Includes polyalphaolefins (PAO) and GTL products | | |
| Group V | All other base oil stocks not included in Groups I, II, III or IV | | |

Natural oils include animal oils, vegetable oils (castor oil and lard oil, for example), and mineral oils. Animal and vegetable oils possessing favorable thermal oxidative stability can be used. Of the natural oils, mineral oils are preferred. Mineral oils vary widely as to their crude source; for example, as to whether they are paraffinic, naphthenic, or mixed paraffinic-naphthenic. Oils derived from coal or shale are also useful. Natural oils vary also as to the method used for their production and purification; for example, their distillation range and whether they are straight run or cracked, hydrorefined, or solvent extracted.

Group II and/or Group III hydroprocessed or hydrocracked base stocks, including synthetic oils such as polyalphaolefins, alkyl aromatics and synthetic esters are also well known base stock oils.

Synthetic oils include hydrocarbon oil. Hydrocarbon oils include oils such as polymerized and interpolymerized olefins (polybutylenes, polypropylenes, propylene isobutylene copolymers, ethylene-olefin copolymers, and ethylene-alphaolefin copolymers, for example). Polyalphaolefin (PAO) oil base stocks are a commonly used synthetic hydrocarbon oil. By way of example, PAOs derived from C8, C10, C12, C14 olefins or mixtures thereof may be utilized. See U.S. Pat. Nos. 4,956,122; 4,827,064; and 4,827,073, which are incorporated herein by reference in their entirety.

The hydrocarbyl aromatics can be used as base oil or base oil component and can be any hydrocarbyl molecule that contains at least about 5% of its weight derived from an aromatic moiety such as a benzenoid moiety or naphthenoid moiety, or their derivatives. These hydrocarbyl aromatics include alkyl benzenes, alkyl naphthalenes, alkyl diphenyl oxides, alkyl naphthols, alkyl diphenyl sulfides, alkylated bis-phenol A, alkylated thiodiphenol, and the like. The aromatics can be mono-alkylated, dialkylated, polyalkylated, and the like. The aromatic can be mono- or poly-functionalized. The hydrocarbyl groups can also be comprised of mixtures of alkyl groups, alkenyl groups, alkynyl, cycloalkyl groups, cycloalkenyl groups and other related hydrocarbyl groups. The hydrocarbyl groups can range from about $C_6$ up to about $C_{60}$ with a range of about $C_8$ to about $C_{40}$ often being preferred. A mixture of hydrocarbyl groups is often preferred. The hydrocarbyl group can optionally contain sulfur, oxygen, and/or nitrogen containing substituents. The aromatic group can also be derived from natural (petroleum) sources, provided at least about 5% of the molecule is comprised of an above-type aromatic moiety. Viscosities at 100° C. of approximately 3 cSt to about 50 cSt are preferred, with viscosities of approximately 3.4 cSt to about 20 cSt often being more preferred for the hydrocarbyl aromatic component. In one embodiment, an alkyl naphthalene where the alkyl group is primary comprised of 1-hexadecene is used. Other alkylates of aromatics can be advantageously used. Naphthalene or methyl naphthalene, for example, can be alkylated with olefins such as octene, decene, dodecene, tetradecene or higher, mixtures of similar olefins, and the like. Useful concentrations of hydrocarbyl aromatic in a lubricant oil composition can be about 2% to about 25%, preferably about 4% to about 20%, and more preferably about 4% to about 15%, depending on the application.

Esters comprise a useful base stock. Additive solvency and seal compatibility characteristics may be secured by the use of esters such as the esters of dibasic acids with monoalkanols and the polyol esters of monocarboxylic acids. Esters of the former type include, for example, the esters of dicarboxylic acids such as phthalic acid, succinic acid, sebacic acid, fumaric acid, adipic acid, linoleic acid dimer, malonic acid, alkyl malonic acid, alkenyl malonic acid, etc., with a variety of alcohols such as butyl alcohol, hexyl alcohol, dodecyl alcohol, 2-ethylhexyl alcohol, etc. Specific examples of these types of esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, etc.

Particularly useful synthetic esters are those which are obtained by reacting one or more polyhydric alcohols, preferably the hindered polyols (such as the neopentyl polyols; e.g., neopentyl glycol, trimethylol ethane, 2-methyl-2-propyl-1,3-propanediol, trimethylol propane, pentaerythritol and dipentaerythritol) with alkanoic acids containing at least about 4 carbon atoms, preferably C5 to $C_{30}$ acids such as saturated straight chain fatty acids including caprylic acid, capric acids, lauric acid, myristic acid, palmitic acid, stearic acid, arachic acid, and behenic acid, or the corresponding branched chain fatty acids or unsaturated fatty acids such as oleic acid, or mixtures of any of these materials.

Suitable synthetic ester components include the esters of trimethylol propane, trimethylol butane, trimethylol ethane, pentaerythritol and/or dipentaerythritol with one or more monocarboxylic acids containing from about 5 to about 10 carbon atoms. These esters are widely available commercially; for example, the Mobil P-41 and P-51 esters of ExxonMobil Chemical Company.

Non-conventional or unconventional base stocks and/or base oils include one or a mixture of base stock(s) and/or base oil(s) derived from: (1) one or more Gas-to-Liquids (GTL) materials, as well as; (2) hydrodewaxed, or hydroisomerized/cat (and/or solvent) dewaxed base stock(s) and/or base oils derived from synthetic wax, natural wax or waxy feeds, mineral and/or non-mineral oil waxy feed stocks such as gas oils, slack waxes (derived from the solvent dewaxing of natural oils, mineral oils or synthetic; e.g., Fischer-Tropsch feed stocks), natural waxes, and waxy stocks such as gas oils, waxy fuels hydrocracker bottoms, waxy raffinate, hydrocrackate, thermal crackates, foots oil or other mineral, mineral oil, or even non-petroleum oil derived waxy materials such as waxy materials received from coal liquefaction or shale oil, linear or branched hydrocarbyl compounds with carbon number of about 20 or greater, preferably about 30 or greater and mixtures of such base stocks and/or base oils.

GTL materials are materials that are derived via one or more synthesis, combination, transformation, rearrangement, and/or degradation/deconstructive processes from gaseous carbon-containing compounds, hydrogen-containing compounds and/or elements as feed stocks such as hydrogen, carbon dioxide, carbon monoxide, water, methane, ethane, ethylene, acetylene, propane, propylene, propyne, butane, butylenes, and butynes. GTL base stocks and/or base oils are GTL materials of lubricating viscosity that a re generally derived from hydrocarbons; for example, waxy synthesized hydrocarbons, that are themselves derived from simpler gaseous carbon-containing compounds, hydrogen-containing compounds and/or elements as feed stocks. GTL base stock(s) and/or base oil(s) include oils boiling in the lube oil boiling range (1) separated/fractionated from synthesized GTL materials such as, for example, by distillation and subsequently subjected to a final wax processing step which involves either or both of a catalytic dewaxing process, or a solvent dewaxing process, to produce lube oils of reduced/low pour point; (2) synthesized wax isomerates, comprising, for example, hydrodewaxed or hydroisomerized cat and/or solvent dewaxed synthesized wax or waxy hydrocarbons; (3) hydrodewaxed or hydroisomerized cat and/or solvent dewaxed Fischer-Tropsch (F-T) material (i.e., hydrocarbons, waxy hydrocarbons, waxes and possible analogous oxygenates); preferably hydrodewaxed or hydroisomerized/followed by cat and/or solvent dewaxing dewaxed F-T waxy hydrocarbons, or hydrodewaxed or hydroisomerized/followed by cat (or solvent) dewaxing dewaxed, F-T waxes, or mixtures thereof.

GTL base stock(s) and/or base oil(s) derived from GTL materials, especially, hydrodewaxed or hydroisomerized/followed by cat and/or solvent dewaxed wax or waxy feed, preferably F-T material derived base stock(s) and/or base oil(s), are characterized typically as having kinematic viscosities at 100° C. of from about 2 $mm^2/s$ to about 50 $mm^2/s$ (ASTM D445). They are further characterized typically as having pour points of −5° C. to about −40° C. or lower (ASTM D97). They are also characterized typically as having viscosity indices of about 80 to about 140 or greater (ASTM D2270).

In addition, the GTL base stock(s) and/or base oil(s) are typically highly paraffinic (>90% saturates), and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stock(s) and/or base oil(s) typically have very low sulfur and nitrogen content, generally containing less than about 10 ppm, and more typically less than about 5 ppm of each of these elements. The sulfur and nitrogen content of GTL base stock(s) and/or base oil(s) obtained from F-T material, especially F-T wax, is essentially nil. In addition, the absence of phosphorous and aromatics make this materially especially suitable for the formulation of low SAP products.

The term GTL base stock and/or base oil and/or wax isomerate base stock and/or base oil is to be understood as embracing individual fractions of such materials of wide viscosity range as recovered in the production process, mixtures of two or more of such fractions, as well as mixtures of one or two or more low viscosity fractions with one, two or more higher viscosity fractions to produce a blend wherein the blend exhibits a target kinematic viscosity.

In a preferred embodiment, the GTL material, from which the GTL base stock(s) and/or base oil(s) is/are derived is an F-T material (i.e., hydrocarbons, waxy hydrocarbons, wax).

EXAMPLE 1

A formulated 5W30 engine oil containing an aminic antioxidant, a phenolic antioxidant, ZDDP and Moly DTC (each component added sequentially and individually to the base oil but without premixing unless otherwise indicated) was employed as the sample test oil to which t-butyl hydroperoxide was added to initiate oxidation. To this formulated oil was added various quantities of soy methyl ether and additional quantities of hindered phenol, diphenylamine, moly trimer, ZDDP and various premixed mixtures thereof. In the test 100 g of the formulated 5W30 engine oil was heated to 160° C. and stirred for three hours in a 2 ml round bottom flask fitted with a water condenser. The t-butyl hydroperoxide was added to the oil when the temperature reached 50° C. Samples of the oil were cooled and titrated both at the time of initial addition of the t-butyl hydroperoxide and at the end of the three hour reflux period, the titration using KI and sodium thiosulfate to a shared end point according to the procedure in ANALYTICAL CHEMISTRY, Vol. 36, No. 1, January 1964, page 194.

In preparing the premixed mixture the components were combined individually in the absence of any solvent or diluent with stirring at 50° C. For example, in preparing the premix of the HP, DPA, ZDDP and MoTri reported in Table 1, the ZDDP was added to a vessel at 50° C. with stirring for 10 minutes after which HP was added and the mixture being stirred for an additional 10 minutes, followed by the addition of DPA and a further 10 minutes of stirring and finally the MoTri and yet another 10 minutes of stirring. The premixed mixture was then added to the formulated 5W30 engine oil in an appropriate amount to deliver the quantity of each compound indicated in Table 1.

The results are presented in Table 1.

TABLE 1

Soy Methyl Ester Hydroperoxide Interactions

| Component | Initial HPN (upon addition), mmole/1000 g oil | Final HPN (after reaction), mmole/1000 g oil |
|---|---|---|
| 0 wt % SME in 5W30 Oil | 0 | 14 |
| 3 wt % SME in 5W30 Oil | 90 | 178 |
| 3 wt % SME in 5W30 Oil + 0.7 wt % DPA | 90 | 141 |
| 3 wt % SME in 5W30 Oil + 0.7 wt % HP | 90 | 157 |
| 3 wt % SME in 5W30 Oil + 0.35 wt % HP + 0.35 wt % DPA (no premix) | 90 | 132 |
| 3 wt % SME in 5W30 Oil + 0.35 wt % HP + 0.35 wt % DPA (premix) | 90 | 116 |
| 3 wt % SME in 5W30 Oil + 0.1 wt % MoTri | 90 | 133 |
| 3 wt % SME in 5W30 Oil + 0.35 wt % HP + 0.35 wt % DPA + 0.1 wt % MoTri (no premix) | 90 | 112 |
| 3 wt % SME in 5W30 Oil + 0.35 wt % HP + 0.35 wt % DPA + 0.1 wt % MoTri (premix) | 90 | 84 |
| 3 wt % SME in 5W30 Oil + 0.2 wt % ZDDP (Lz1371) | 90 | 137 |
| 3 wt % SME in 5W30 Oil + 0.35 wt % HP + 0.35 wt % DPA + 0.1 wt % MoTri + 0.2 Wt % ZDDP (no premix)(2 runs) | 90 | 130<br>115 |
| 3 wt % SME in 5W30 Oil + 0.35 wt % HP + 0.35 wt % DPA + 0.1 wt % MoTri + 0.2 wt % ZDDP (Lz1371) (premix) | 90 | 62 |

HPN = hydroperoxide number
SME = soy methyl ester
DPA = diphenyl amine (Irganox L-57, 100 wt % active ingredient)
HP = hindered phenol (Hitec 4702, 100 wt % active ingredient)
MoTri = molybdenum trimer (U.S. Pat. No. 5,824,627)
ZDDP = zinc dialkyl dithiophosphate (Lz1371).

EXAMPLE 2

Pressure Differential Scanning Calorimetry (PDSC) was used to evaluate the effectiveness of antioxidants on a mixture comprising a 2:1 ratio of methyl linoleate (C18,2):methyl oleate (C18,1). This is the ratio of the C18,2 and C18,1 in soy methyl ester. In a typical experiment about 6 mg of compound is weighed into a DSC pan. The system is pressurized to 100 psi with air and heated at 10° C. per minute from ambient temperature (25° C.) to 350° C. The oxidation onset temperature is determined from the heat flow as a function of temperature plot.

Results from the PDSC experiments is shown in Table 2 below. It was observed that ZDDP at 2800 ppm concentration has no effect on increasing the oxidation onset temperature. However, diphenyl amine and a bisphenol individually were found to be effective in increasing the oxidation onset temperature by 16° C. and 28° C. respectively. When a mixture of ZDDP: DPA: BP was used each at 900 ppm for a total of 2800 ppm, the oxidation onset temperature was increased by 41° C. This increase in oxidation onset temperature is very significant and demonstrates the synergistic effect between the aryl amine, the hindred phenol, bisphenol and ZDDP additives in increasing the oxidative stability of biodiesel components.

TABLE 2

| | Onset Temperature | Sample # |
|---|---|---|
| 2:1 Mixture C18, 2 and C18, 1 | 154° C. | 1 |
| 2:1 Mixture + ZDDP | 157° C. | 2 |
| 2:1 Mixture + Diphenyl Amine (DPA) | 170° C. | 3 |
| 2:1 Mixture + Bisphenol (BP) | 182° C. | 4 |
| 2:1 Mixture + 1:1:1 Mixture of ZDDP:DPA:BP (no premix; sequential addition) | 182° C. | 5 |
| 2:1 Mixture + 1:1:1 Mixture ZDDP:DPA:BP (premix) | 195° C. | (Comparative) 6 (Inventive) |

What is claimed is:

1. A method for controlling the oxidation of diesel engine lubricating oils caused by the use of biodiesel fuels in the diesel engine, said method comprising the addition to the lubricating oil of an additive comprising a premixed mixture of:

(A) a first antioxidant selected from a hindered phenol antioxidant, wherein the hindered phenol antioxidant is 4,4'-methylene-bis (2,6-di-t-butyl phenol) at a loading of about 0.35 wt %;

(B) a second antioxidant selected from a diphenyl amine antioxidant, wherein the diphenyl amine antioxidant is alkyl diphenylamine having alkyl substituted group(s) of at least 6 carbon atoms at a loading of about 0.35 wt %; and (C) a third catalytic antioxidant including molybdenum dithiocarbamate at a loading of about 0.1 wt %, and optionally ZnDDP at a loading of about 0.2 wt %; and, (D) wherein the premixed mixture is prepared by combining (A), (B) and (C) in the absence of any solvent or diluent, and mixing with stirring at a temperature of about 50° C. from 30 to 40 minutes, wherein the lubricating oil is a formulated 5W30 engine oil including 3 wt % of soy methyl ester.

2. The method of claim 1 wherein the premix is added to the lubricating oil in an amount in the range of about 0.8 to 1.0 wt %, based on active ingredients of the components.

3. The method of claim 1, wherein the premix is prepared by first adding the organometallic compound, then adding sequentially either of the first or second antioxidant in any sequence to the organometallic compound.

4. The method of claim 1, wherein the diesel engine lubricating oils have a final hydroperoxide number after reaction that is at least 6.7% lower than the initial hydroperoxide number upon addition.

* * * * *